US009469961B2

(12) United States Patent
Heichel et al.

(10) Patent No.: US 9,469,961 B2
(45) Date of Patent: Oct. 18, 2016

(54) APPARATUS FOR PILE-DRIVING OR DRILLING

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Albrecht Kleibl, Grossostheim (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 0 days.

(21) Appl. No.: 14/636,288

(22) Filed: Mar. 3, 2015

(65) Prior Publication Data

US 2015/0275459 A1 Oct. 1, 2015

(30) Foreign Application Priority Data

Apr. 1, 2014 (EP) ..... 14163092

(51) Int. Cl.

| | |
|---|---|
| ***E02D 7/22*** | (2006.01) |
| ***E02D 7/18*** | (2006.01) |
| ***E21B 7/02*** | (2006.01) |
| ***E21B 3/02*** | (2006.01) |
| ***E21B 1/02*** | (2006.01) |

(52) U.S. Cl.

CPC . *E02D 7/18* (2013.01); *E02D 7/22* (2013.01); *E21B 1/02* (2013.01); *E21B 3/02* (2013.01); *E21B 7/022* (2013.01)

(58) Field of Classification Search

CPC ..... E02D 7/10

See application file for complete search history.

(56) References Cited

U.S. PATENT DOCUMENTS 5,752,571 A * 5/1998 Sapozhnikov ..... B25D 9/18 173/13

5,894,781 A 4/1999 Kuvshinov

FOREIGN PATENT DOCUMENTS

DE 197 34 966 A1 2/1998

OTHER PUBLICATIONS

European Search Report dated Oct. 6, 2014 in European Application No. 14 16 3092 with English translation of the relevant parts.

* cited by examiner

*Primary Examiner* — Tara M. Pinnock

(74) *Attorney, Agent, or Firm* — Collard & Roe, P.C.

(57) ABSTRACT

An apparatus for pile-driving or drilling, particularly a foundation machine, including at least one hydraulic drilling or vibration drive, which is connected with a control block in an open hydraulic circuit, by way of which drive at least one further consumer can be operated. The drive is connected with a pump by way of a first feed line and with a tank by way of a first return line. The hydraulic drive is additionally connected directly with the pump by way of a second feed line, and directly with the tank by way of a second return line.

7 Claims, 6 Drawing Sheets

APPARATUS FOR PILE-DRIVING OR DRILLING

CROSS REFERENCE TO RELATED APPLICATIONS

Applicant claims priority under 35 U.S.C. §119 of European Application No. 14163092.1 filed Apr. 1, 2014, the disclosure of which is incorporated by reference.

BACKGROUND OF THE INVENTION

1. Field of the Invention

The invention relates to an apparatus for pile-driving or drilling, particularly a foundation machine.

2. Description of the Related Art

Leader-guided vibration pile drivers as well as drilling devices and foundation machines in general are regularly operated hydraulically. In this connection, an open hydraulic circuit is used, because in this way, in contrast to a closed circuit, the operation of different work devices, such as, for example, vibrators, drilling drives, presses, etc., as well as a switch between different consumers such as a work device or a drive of a crawler track drive is made possible. The open hydraulic circuit has a control block or valve block, from which different consumers can be controlled.

The previously known solutions have the disadvantage that the control block represents a hydraulic resistance for the oil volume stream. For this reason the control block brings about a reduction in the power to be transferred. A reduction of this power loss can be achieved by means of using a larger block having a larger cross-section, but this larger block requires a lot of construction space and is furthermore very expensive.

The lost power of the control block is caused by the flow valves used in the control block. Flow valves correspond to throttle valves in terms of their construction, and allow control of the hydraulic volume stream by way of a changeable pressure loss. The valves of the control block are controlled directly by the operator, by way of a manual controller, for example by means of a joystick (hydraulic pre-controller), or also by way of auxiliary valves, also called pre-control valves, which in turn are activated electrically by the operator. If only one consumer is being operated, for example a vibration pile-driver during pile-driving operation, when a vibrator uses the full power as the sole consumer, the control block does not have any function; it merely serves to pass the oil volume stream through, but does hinder the passage of the oil volume stream as a consequence of the design-related flow resistance.

SUMMARY OF THE INVENTION

The invention wishes to provide a remedy for this situation. The invention is based on the task of making available an apparatus for pile-driving or drilling, particularly a foundation machine having a hydraulic drilling or vibration drive, in which the hydraulic power lost as the result of the flow resistance in the control block is reduced. According to the invention, this task is accomplished by means of an apparatus for pile-driving or drilling, particularly a foundation machine, including at least one hydraulic drilling or vibration drive, which is connected with a control block in an open hydraulic circuit. By way of the drive at least one further consumer can be operated. The drive is connected with a pump by way of a first feed line and with a tank by way of a first return line. The hydraulic drive is additionally connected directly with the pump by way of a second feed line, and directly with the tank by way of a second return line.

With the invention, an apparatus for pile-driving or drilling, particularly a foundation machine having a hydraulic drilling or vibration drive, is created, in which the hydraulic power lost as the result of the flow resistance in the control block is reduced. Because the drive is additionally connected directly with the pump, by way of a second feed line, and directly with the tank, by way of a second return line, the control block is disposed hydraulically parallel to the actual working lines that lead directly from the pump to the work device as the main consumer and from the work device to the tank. The control block is therefore switched as a bypass for the direct connections between pump and working device and between working device and tank. In this way, direct application of hydraulic oil to the work device is made possible.

In a further development of the invention, a valve, preferably a directional valve for blocking the line, is disposed, in each instance, in the second feed line as well as in the second return line, in such a manner that in the blocked state of the second feed line and of the second return line, the control block functions as the only connection between pump and drive. Consequently, unrestricted supply to the consumers connected with the control block is guaranteed. The main volume stream flows through the control block, as described in the state of the art.

In a further development of the invention, a valve, preferably a directional valve, is disposed in the first feed line for blocking this line. As a result, after this valve is closed, no division of the volume stream in accordance with the hydraulic resistances both by way of the block and by way of the direct connection takes place. Because of the separation of the control block from the hydraulic circuit, a greater pressure can be permitted also in the case that the pressure in the hydraulic circuit is limited by the design-related permissible pressure in the control block.

In a further embodiment of the invention, the drive is directly connected with the pump by way of a third return line. In this embodiment at least one valve, in each instance, preferably a directional valve, is provided for optional separation of the hydraulic drive with the tank and connection of the hydraulic drive and the pump, in such a manner that a closed circuit between pump and drive can be achieved. Via the valves provided, the suction line in the pump can be optionally connected with the tank or with the return line from the work device. In this way, priming losses of the pump can be avoided.

Furthermore, the pump can be impacted with an elevated input pressure in this manner. Last but not least, greater efficiency can be achieved by means of a closed hydraulic circuit.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
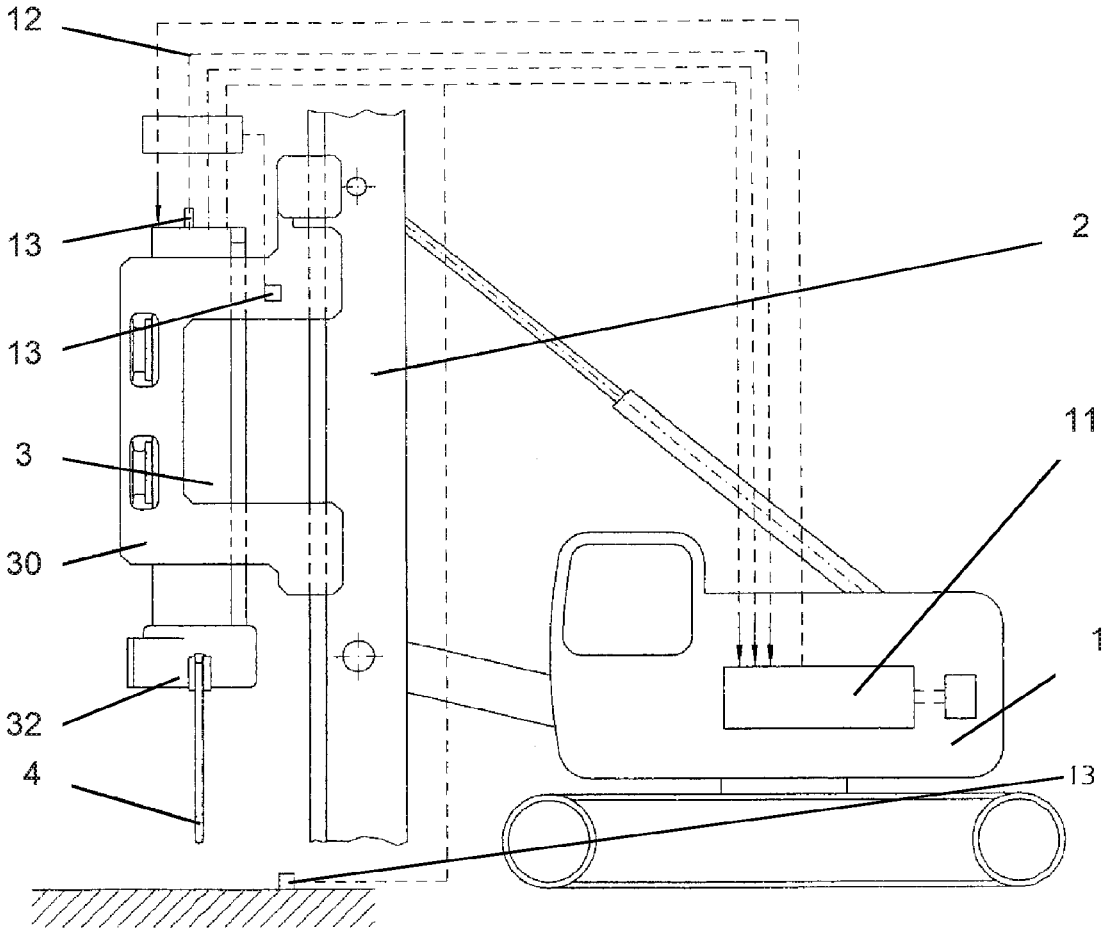
FIG. 1 is a schematic representation of a vibration pile-driver disposed on a carrier device.

Referring now in detail to the drawings the apparatus according to the invention will be described using a vibration pile-driver, the essential components of which are shown in FIG. 1. A vibration generator (vibrator) 3 is disposed on a carrier device 1, so as to be vertically displaceable by way of a leader 2. The vibration generator 3 comprises a housing 31 (FIG. 2) that is surrounded by a hood 30. A clamping gripper 32 for holding material 4 to be pile-driven is disposed on the hood 30. The hood 30 serves for guiding the vibration generator 3 and transfers the static force of the leader 2 to the vibration generator 3. The vibration generator 3 generates a vibration, by way of rotating imbalances 3311, 3321, 3331, 3511, 3521, 3531, which vibration is transferred to the material 4 to be pile-driven by way of the clamping gripper 32. Control of the vibration pile-driver takes place by way of a controller apparatus 11 that is connected with different sensors 13 by way of lines 12.

Figure 2:
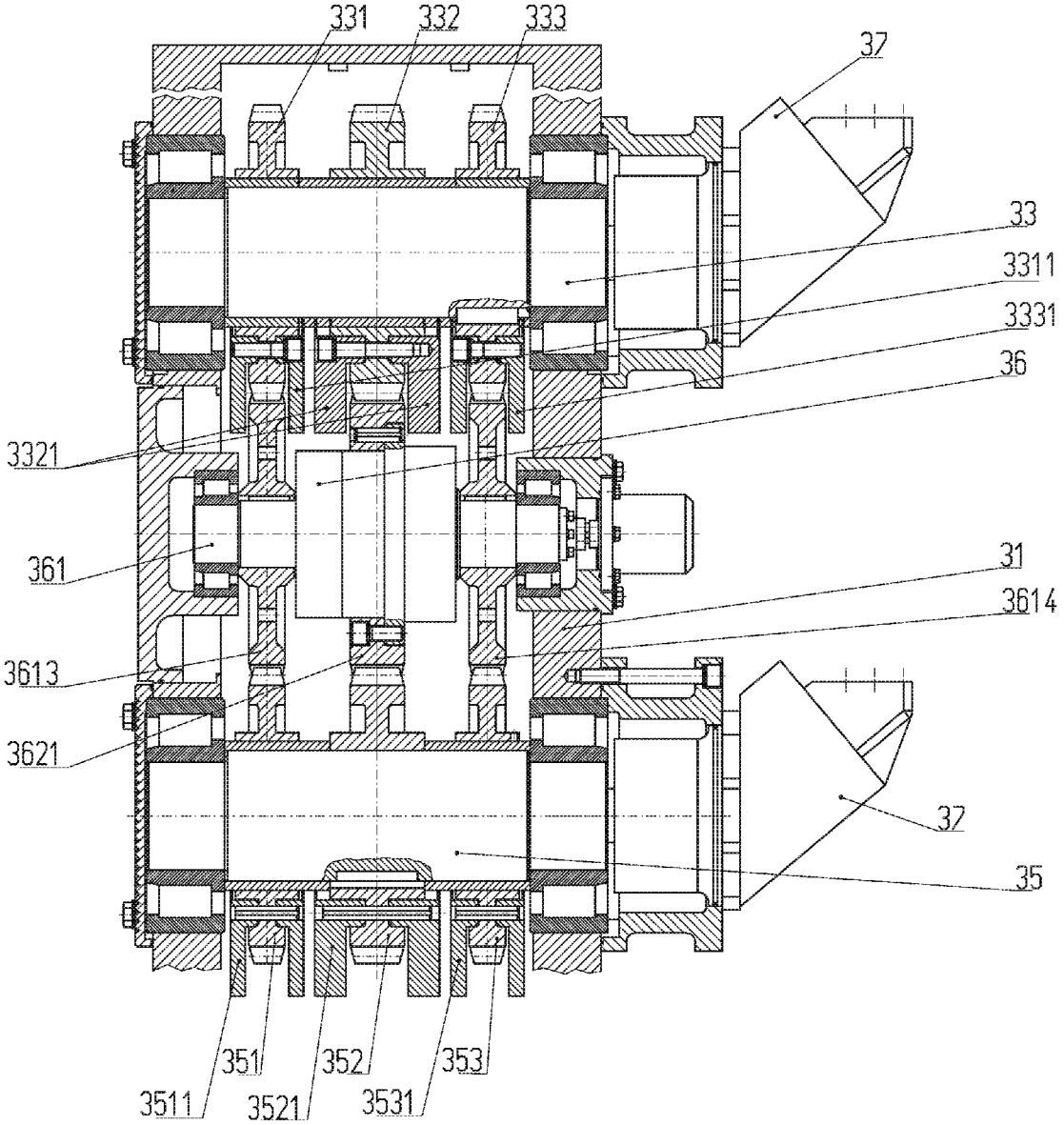
FIG. 2 is a schematic representation of the vibrator drive of the vibration pile-driver from FIG. 1.

The vibration generator 3 is structured as a vibrator gear mechanism (FIG. 2). It consists essentially of a housing 31, in which shafts 33, 35 provided with gear wheels 331, 332, 333, 351, 352, 353 are mounted so as to rotate. The gear wheels 331, 332, 333, 351, 352, 353 are provided with imbalance masses 3311, 3321, 3331, 3511, 3521, 3531, in each instance, whereby the gear wheels of the two shafts 33, 35 are in engagement with one another by way of gear wheels 3613, 3614 of the rotor shaft 361 of a pivot motor 36 or with the gear wheel 3621 of the pivot motor 36. The gear wheels 331, 332, 333, 351, 352, 353 provided with imbalance masses 3311, 3321, 3331, 3511, 3521, 3531 can be adjusted relative to one another, in terms of their rotational position, by way of the pivot motor 36, thereby making it possible to adjust the resulting imbalance or the resulting static moment. The shafts 33, 35 of the vibration generator 3 are connected with hydraulic drives 37, by way of which they can be driven. The hydraulic drives 37 are connected with a hydraulic circuit 5 shown, for example, in FIGS. 3-6, by way of which they are supplied with hydraulic oil.

Figure 3:
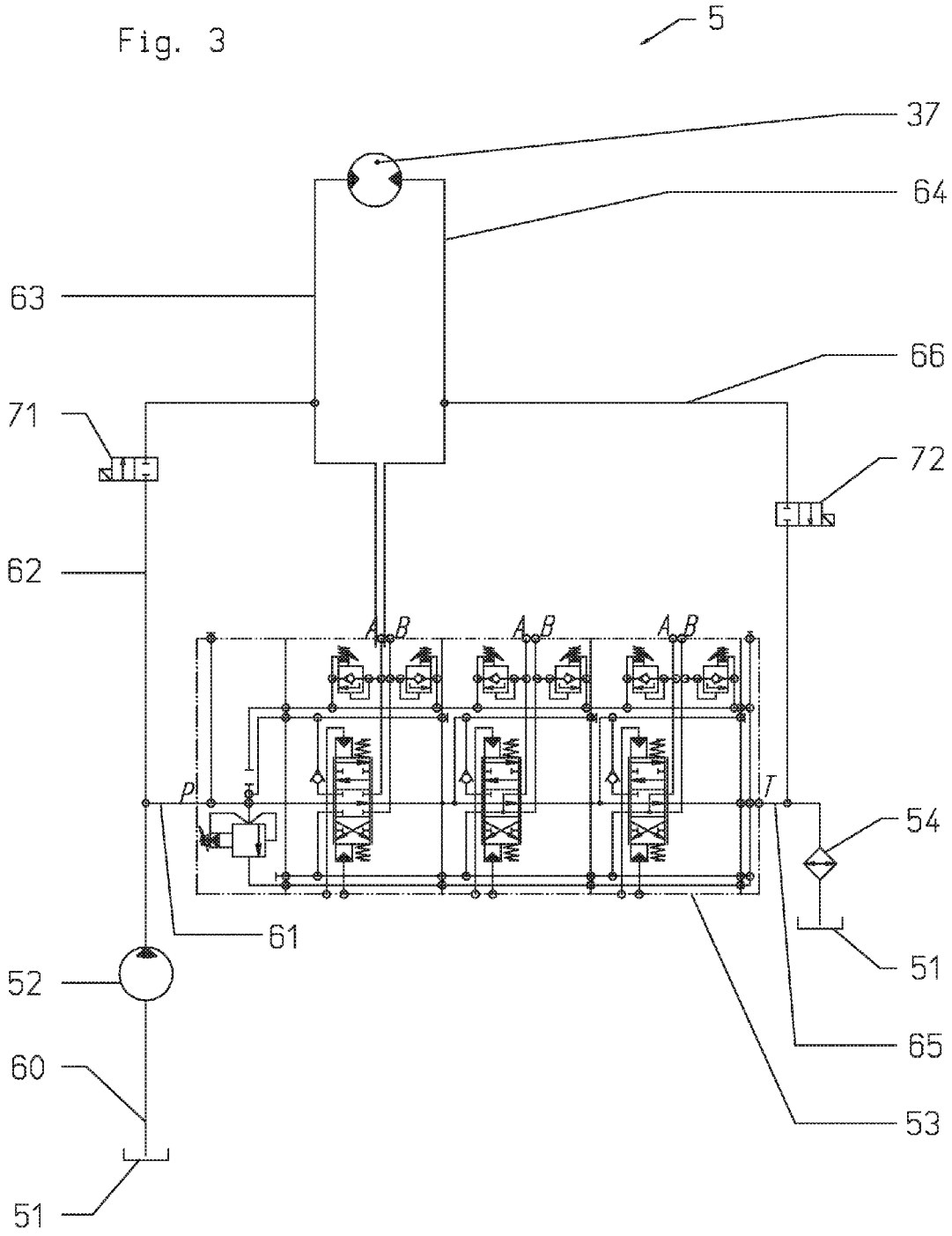
FIG. 3 is a representation of a hydraulic plan for supplying the hydraulic drives of the vibrator gear mechanism from FIG. 2.

The hydraulic circuit 5 is shown in a first embodiment in FIG. 3. A control block 53 is disposed in the hydraulic circuit 5, which block is connected with a pump 52 by way of a first supply line 61, which pump in turn is connected with a tank 51 for the hydraulic oil by way of a supply line 60. On the return side, the control block 53 is connected with the tank 51 by way of a first return line 65 that is passed by way of a cooler 54. The hydraulic drive 37 is connected with the control block 53, on the inflow side, by way of a drive feed line 63, and, on the return flow side, by way of a drive return line 64, by way of hydraulic connectors A, B. In the exemplary embodiment, two further connectors A, B, for further consumers are provided on the control block 53.

The drive feed line 63 is directly connected with the pump 52 by way of a second feed line 62. Furthermore, the drive return line 64 is directly connected with the tank 51 by way of a second return line 66, by way of the cooler 54. A first directional valve 71 is disposed in the second feed line, and a second directional valve 72 is disposed in the second return line. Feed to the hydraulic drive 37 by way of the control block 53 takes place by means of blocking the directional valves 71, 72; further consumers can be supplied at further connectors A, B of this block. In the open state of the directional valves 71, 72, the volume stream flows past the control block 53 without hindrance, whereby the entire volume stream divides in accordance with the hydraulic resistances and flows both by way of the control block 53 and directly to the hydraulic motor 37.

Figure 4:
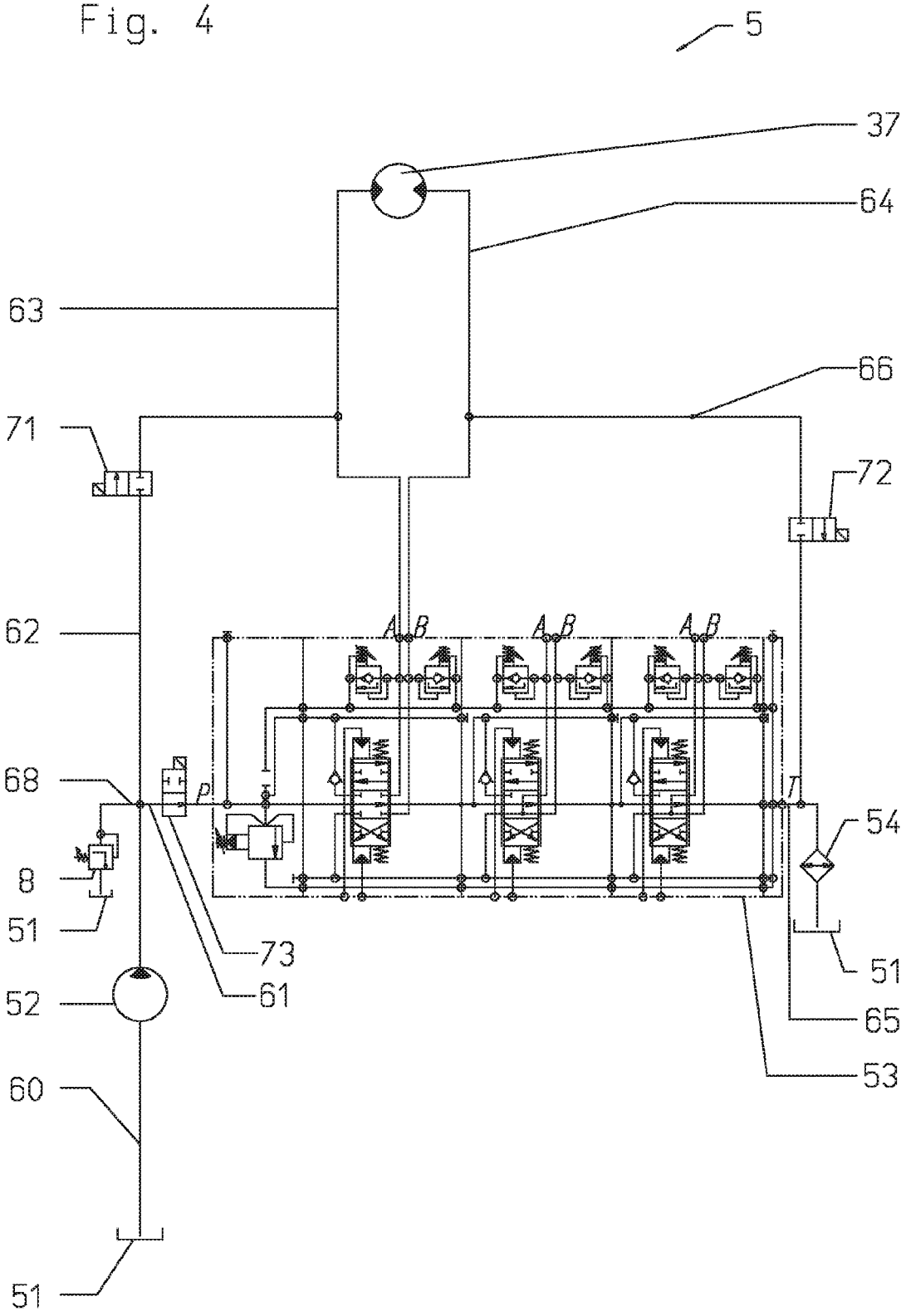
FIG. 4 is a representation of the hydraulic plan from FIG. 3 in another embodiment.

In the exemplary embodiment according to FIG. 4, a third directional valve 73 is disposed in the first feed or supply line 61, ahead of the control block 53. By means of this additional directional valve 73, the control block 53 can be separated from the hydraulic circuit 5 on the primary side, so that the volume stream conveyed by the pump 52 flows entirely to the hydraulic drive 37. Furthermore, an excess pressure line 68 is connected with the first feed line 61 as well as with the second feed line 62, which line ends in the tank 51 and in which line an excess pressure valve 8 is disposed.

Figure 5:
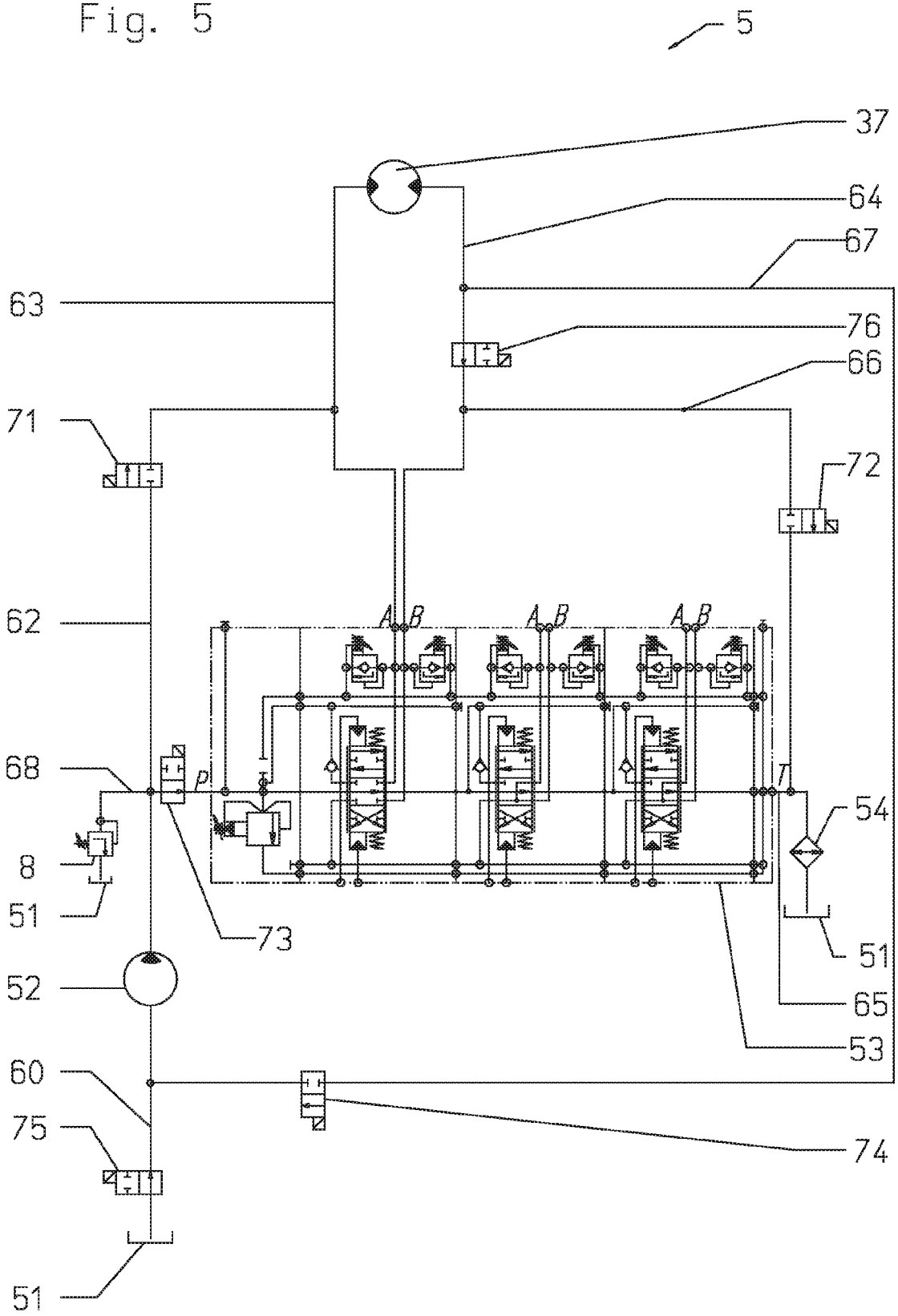
FIG. 5 is a representation of the hydraulic plan from FIG. 3 in a third embodiment.
Figure 6:
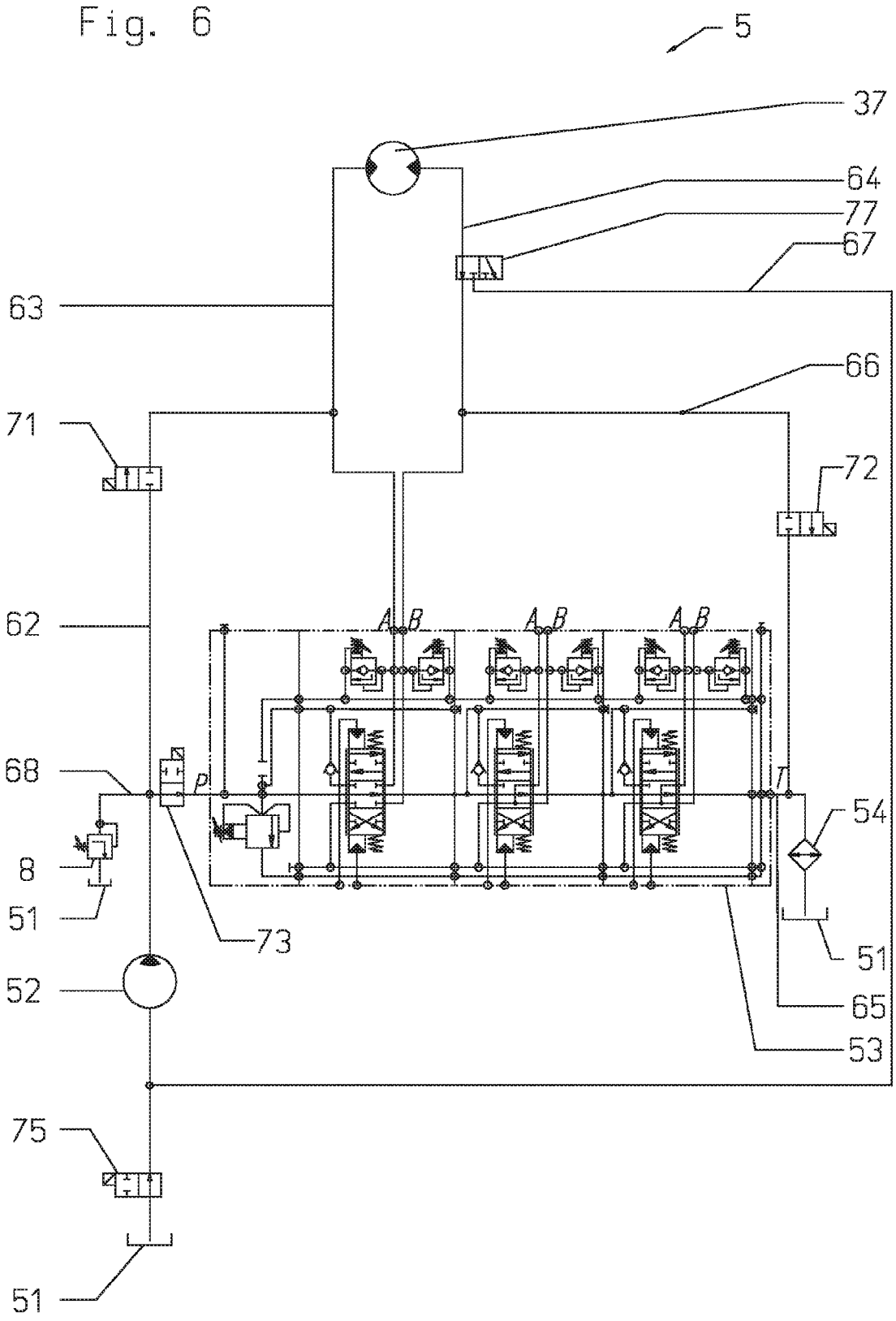
FIG. 6 is a representation of the hydraulic plan from FIG. 3 in a fourth embodiment.

In the exemplary embodiments according to FIGS. 5 and 6, the drive return line 64 is additionally connected with the supply line 60 of the pump 52 by way of a third return line 67, so that a closed circuit is formed. A fourth directional valve 74 is disposed in the third return line 67. A fifth directional valve 75 is disposed on the supply line 60 between the tank 51 and the connector of the third return line 67. Furthermore, a sixth directional valve 76 is disposed in the drive return line 64 of the hydraulic drive 37, between the second return line 66 and the third return line 67. By means of this arrangement, the supply line 60 of the pump 52 is optionally connected with the tank 51 or with the drive return line 64. In this way, priming losses of the pump 52 can be avoided, for example. Furthermore, in this manner the pump 52 can have increased input pressure applied to it.

In the exemplary embodiment according to FIG. 6, the directional valves 74 and 76 were replaced with a seventh directional valve 77 configured as a multi-directional valve, by way of which the return line 67 is connected with the drive return line 64.

Because of the losses that occur in every hydraulic circuit, the hydraulic oil warms up and therefore must be cooled. Oil coolers are regularly permitted for low pressures up to approximately 20 bar. When the circuit is open (directional valves 75, 76 open, directional valve 74 closed), the hydraulic oil runs into the tank 51 essentially without pressure, which oil is passed, in usual manner, to the tank 51 by way of an oil cooler. When the circuit is closed (directional valve 74 open, directional valves 75, 76 closed), such cooling is not easily possible. In order to cool the hydraulic oil in a closed circuit, the leakage oil that occurs in any case is regularly cooled. If necessary, an additional amount of oil is dispensed and passed by way of a cooler. The cooled oil must be returned to the hydraulic circuit by way of a feed pump. (In FIGS. 5 and 6, the possibility of taking the hydraulic fluid out and feeding it back in, in order to cool it, is not shown.)

Although only a few embodiments of the present invention have been shown and described, it is to be understood that many changes and modifications may be made thereunto without departing from the spirit and scope of the invention.

What is claimed is:

1. An apparatus for pile-driving or drilling comprising:

(a) at least one first hydraulic drive comprising a hydraulic drilling drive or a hydraulic vibration drive for operating at least one second drive or work device;

(b) a control block connected with the at least one first hydraulic drive in an open hydraulic circuit;

(c) a pump connected with the at least one first hydraulic drive by way of a first feed line and directly connected with the at least one first hydraulic drive by way of a second feed line;

(d) a tank connected with the at least one first hydraulic drive by way of a first return line and directly connected with the at least one first hydraulic drive by way of a second return line; and (e) a block blocking at least one of the second feed line directly connecting the pump with the at least one first hydraulic drive and the second return line directly connecting the at least one first hydraulic drive with the tank, wherein in a blocked state of at least one of the second feed line and the second return line, the control block represents a sole connection between the pump and the at least one first hydraulic drive.

2. The apparatus according to claim 1, wherein the block comprises first and second valves, wherein the first valve is provided in the second feed line and the second valve is provided in the second return line for blocking the second return line, so that in the blocked state of the second line and of the second return line, the control block represents the sole connection between the pump and the at least one first hydraulic drive.

3. The apparatus according to claim 2, wherein the first and second valves are directional valves.

4. The apparatus according to claim 2, further comprising a third valve disposed in the first feed line for blocking the first feed line.

5. The apparatus according to claim 4, wherein the third valve is a directional valve.

6. The apparatus according to claim 4, wherein the at least one first hydraulic drive is directly connected with the pump by way of a third return line, wherein at least a fourth valve is provided for optionally separating the at least one first hydraulic drive from the tank and at least a fifth valve is provided for connecting the at least one hydraulic drive and the pump so that a closed circuit is achieved between the pump and the at least one first hydraulic drive.

7. The apparatus according to claim 6, wherein the fourth and fifth valves are directional valves.

* * * * *